United States Patent [19]

Bailey et al.

[11] 4,361,375

[45] Nov. 30, 1982

[54] MINIATURE AUDIO CONNECTOR

[75] Inventors: James R. Bailey, Chicago; John R. Herron, Park Ridge, both of Ill.

[73] Assignee: Switchcraft, Inc., Chicago, Ill.

[21] Appl. No.: 187,287

[22] Filed: Sep. 15, 1980

[51] Int. Cl.[3] ..... H01R 13/629

[52] U.S. Cl. ..... 339/91 R; 339/132 R

[58] Field of Search ..... 339/91 R, 91 P, 126 R, 339/126 J, 129, 132 R

[56] References Cited

U.S. PATENT DOCUMENTS

| | | | |
|---|---|---|---|
| 2,000,318 | 5/1935 | Cannon | 339/91 R |
| 3,219,961 | 11/1965 | Bailey et al. | 339/91 R |
| 3,639,950 | 2/1972 | Lutz et al. | 339/91 R |
| 3,671,922 | 6/1972 | Zerlin et al. | 339/91 R |
| 3,885,849 | 5/1975 | Bailey et al. | 339/132 R |
| 4,261,628 | 4/1981 | Gallagher | 339/91 R |
| 4,316,647 | 2/1982 | Bailey et al. | 339/91 R |

FOREIGN PATENT DOCUMENTS

| | | | |
|---|---|---|---|
| 1391523 | 4/1975 | United Kingdom | 339/91 R |

*Primary Examiner*—John McQuade

*Attorney, Agent, or Firm*—John T. Meaney; Joseph D. Pannone; Richard M. Sharkansky

[57] ABSTRACT

An audio connector having a stationary member adapted to be mounted on a chassis or panel and a detachable member adapted to be interfitted with said stationary member. The stationary member has a post-like conductive housing disposed within a hollow collar member. The hollow collar member has an intermediate escutcheon plate for mounting the collar member to the chassis or panel. The stationary member has a plurality of female conductive pin receptacles for mating with male pins of the detachable member. The stationary member includes a unitary resilient latch having an elongated tongue-like conductive portion and a pair of conductive wing-like members offset from the elongated conductive portion. The detachable member has a sleeve-like conductive housing with a polarization groove for receiving the elongated conductive portion of the resilient latch and a lip cut through the polarization groove for engaging the conductive wing-like members when the detachable member is interfitted with the stationary member to lock the detachable and stationary members together. The stationary member includes a spring-loaded release mechanism having an elongated conductive lever. When it is desired to separate the detachable and stationary members the spring-loaded release mechanism slides to disengage the wing-like members from the lip. The stationary member is grounded through the mounting means to the chassis or panel and the tongue-like conductive portion is in electrical contact with the detachable member to provide electrical continuity between the detachable and stationary members. The latching system also reduces mechanical vibrations between the interfitted connector members and provides positive latching for the audio connector.

8 Claims, 21 Drawing Figures

MINIATURE AUDIO CONNECTOR

BACKGROUND OF THE INVENTION

The invention relates generally to electrical connectors, and more particularly, to such connectors suitable for use in audio systems.

U.S. Pat. No. 3,219,961, issued to the present inventors James R. Bailey et al, Nov. 23, 1965 and assigned to the assignee of the present invention, discloses a prior art electrical connector suitable for use in audio systems. Such connector includes a pair of detachable members, one member being connected to a source of sound, such as a microphone, and the other being connected, for example, to an audio amplifier. One member provides a sleeve-like female receptacle for the other member. When mechanically interfitted the pair of members electrically interconnect the microphone and the audio system. A mechanical release latch is provided to disengage the members as desired. The mechanical latching system comprises a rigid latch with a separate biasing spring. The latch is provided with pivot projections at one end and at the end remote thereto, a finger piece and a detent which engages a notch in the inner walls of one of the pair of detachable members. In certain applications it is desired that one of the members, such as the one containing the plural female pin receptacles, be mounted on a panel or chassis and the male connector assembly having a polarization mating groove be interfitted with the stationary member. In order to ensure electrical continuity as well as positive latching of the stationary and detachable members a separate internally disposed resilient conductive element is used to bridge the interfitted members when mated. Consequently, while such prior art connector is useful in many applications, when such connector is to be miniaturized in size use of plural components makes assembly difficult. Further, with one of the connector members stationary mounted a new and unique latch release mechanism is desired.

SUMMARY OF THE INVENTION

The present invention overcomes the above and other disadvantages of the prior art by the provision of an audio connector comprising the combination of stationary and detachable members, such detachable member being, for example, a male member having a hollow sleeve-like conductive housing including a base-pin insert with a plurality of male conductive contact pins. The stationary member has an appended escutcheon plate for panel or chassis mounting and a post-like conductive housing member being, for example, a female connector member having a plurality of receptacles adapted to mate with the contact pins. The post-like female conductive housing is shaped to interfit in coaxial alignment within the hollow sleeve-like conductive housing member of the male connector. A mechanical latching system includes a unitary latch, having an elongated resilient tongue-like portion with a pair of offset conductive wing-like members interconnected to a spring-actuated slidably disposed lever of the release mechanism. The unitary latch is in electrical contact with a polarization groove formed in a hollow passageway of the sleeve-like male conductive housing having a lip formed within its inner passageway wall with the polarization groove cut through one section of such lip. The stationary female receptacle member is interfitted within the male member with the elongated resilient tongue-like portion of the latch positioned within the polarization groove to mechanically key the orientation and mating of the connector members. When inserted, the tongue-like portion of the latch passes through the polarization grooves, and the wing-like members engage the lip formed within the hollow conductive sleeve-like housing member of the male connector member to inter-lock the conductors. The conductors are disengaged when the spring-actuated release mechanism mounted on the stationary member is slid to depress the latch and thereby remove the wing-like members from the lip of the housing. The tongue-like portion of the latch system engages the inner walls of polarization groove to provide electrical continuity between the mated stationary and detachable conductive housing members, reduce mechanical vibrations between the mated components and ensure positive latching.

BRIEF DESCRIPTION OF THE DRAWINGS

The above-mentioned and other features of the invention will become apparent by reference to the following detailed description taken together in conjunction with the accompanying drawings wherein like reference numerals designate like parts throughout the following described views:

FIG. 13 A is a view similar to FIG. 13 showing the interfitted male and female connector members, partially detached with the release button lever and latch assembly depressed.

DESCRIPTION OF THE PREFERRED EMBODIMENTS

Figure 1:
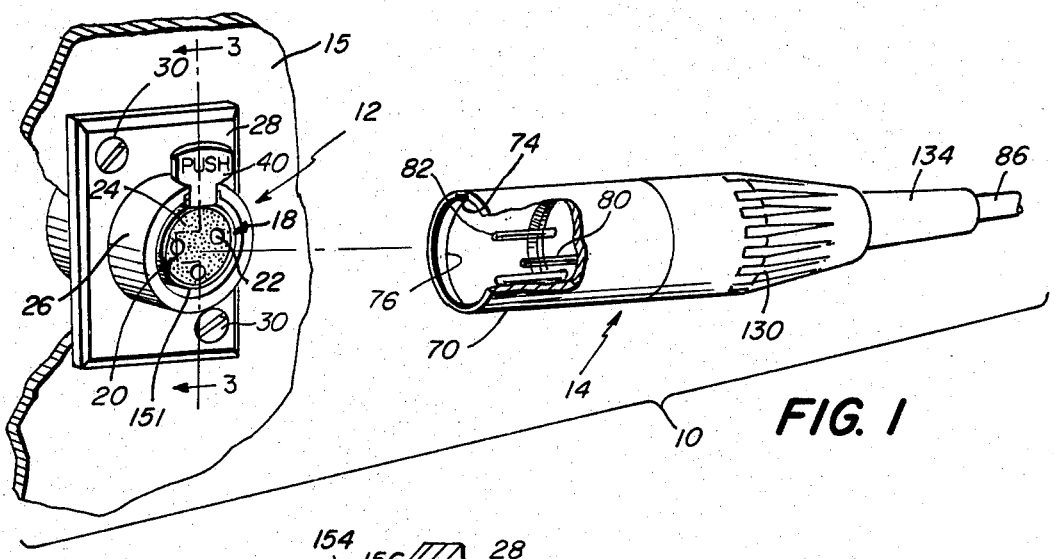
FIG. 1 is an exploded pictorial view of the stationary and detachable member components of the connector according to the invention.
Figure 3:
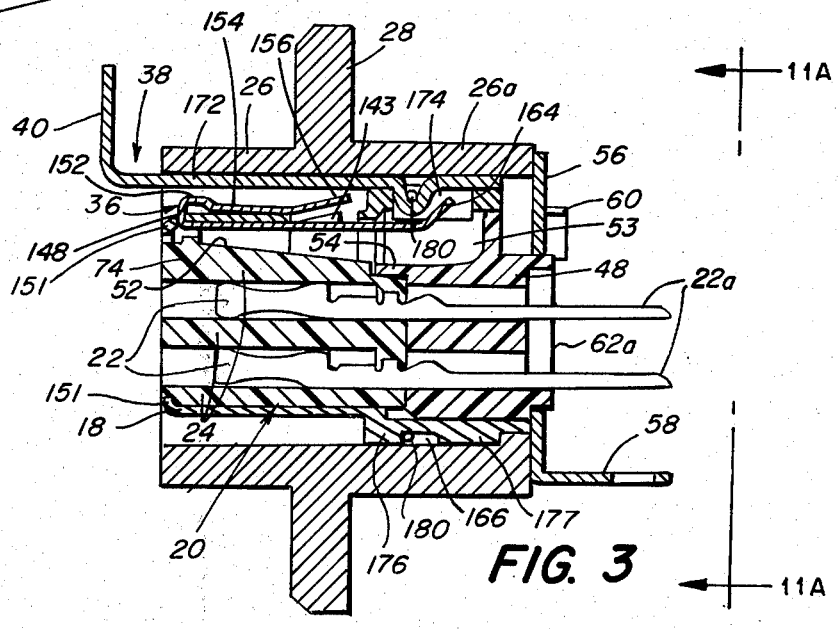
FIG. 3 is a detailed cross-sectional view of the assembled stationary connector member components taken along line 3—3 shown in FIG. 1.
Figure 2A:
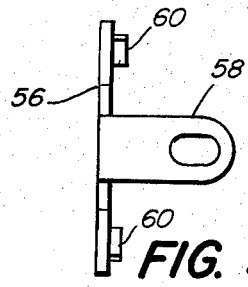
FIGS. 2A & 2B are plan views of the lock ring terminal member in FIGS. 2, 3 and 11 for solder and printed circuit applications, respectively.
Figure 2B:
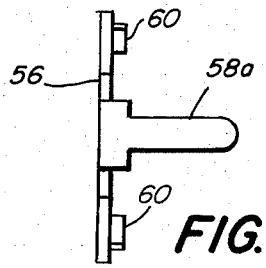
Figures 2, 4, 4A:
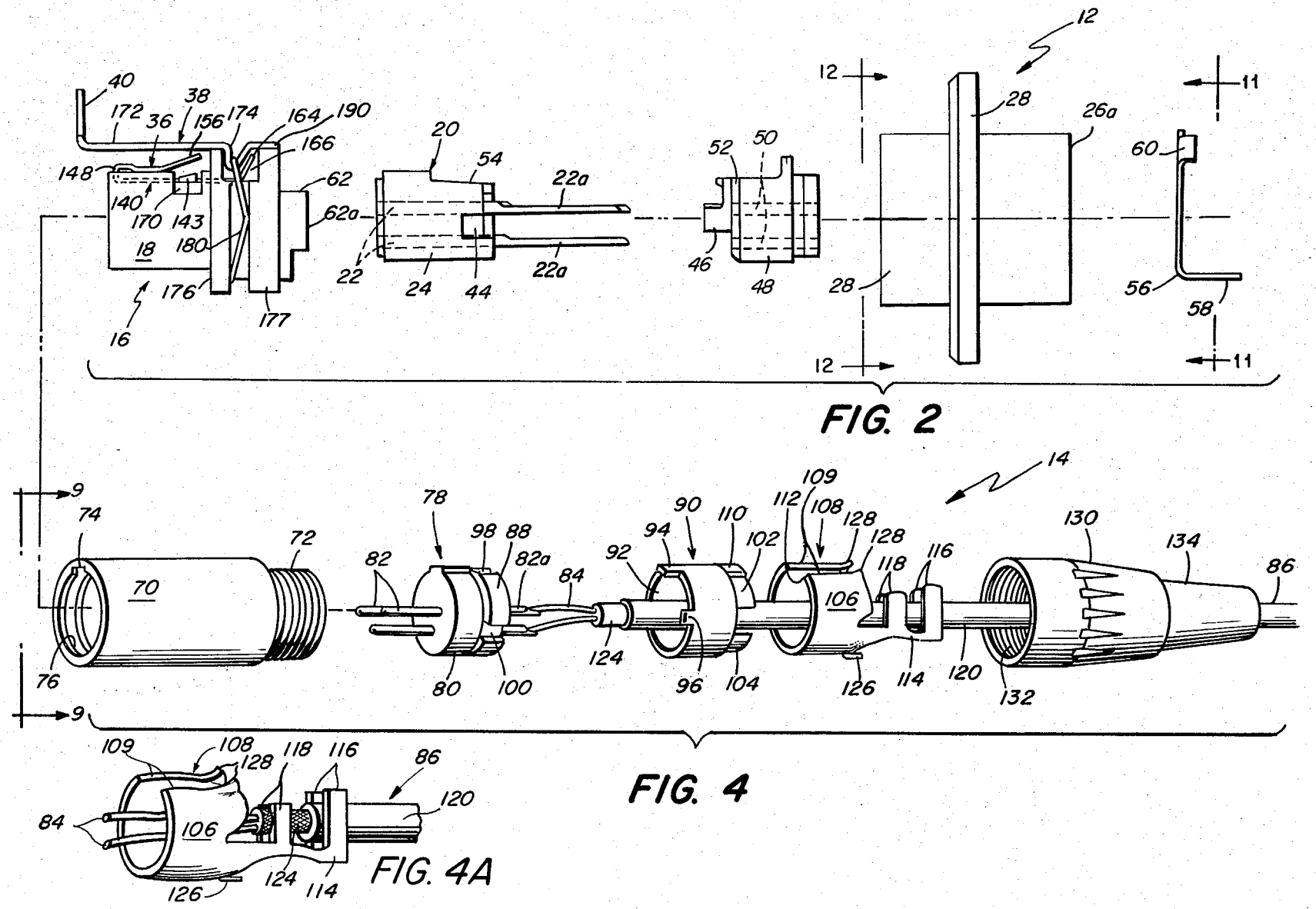
FIG. 2 is an exploded pictorial view of the components of the stationary mounted female member of the audio connector shown in FIG. 1.
FIG. 4 is an exploded pictorial view of the detachable male connector member, shown in FIG. 1.
FIG. 4A is an isometric view of a preferred cable clamp with the cable conductor attached.
Figure 12:
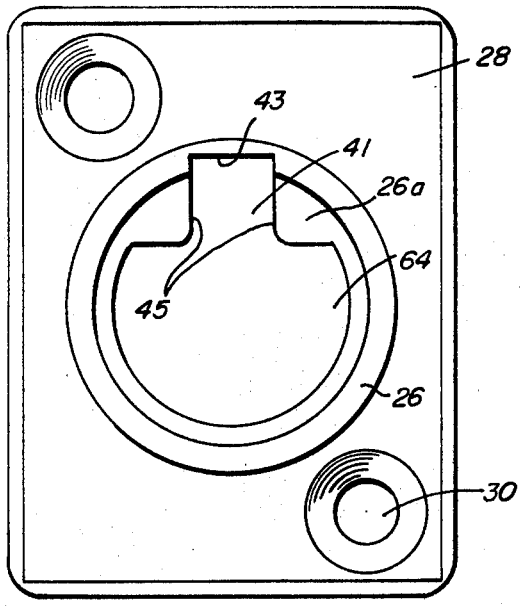
FIG. 12 is an end elevation view of the collar and escutcheon plate member taken along the line 12—12 in FIG. 2.
Figure 7:
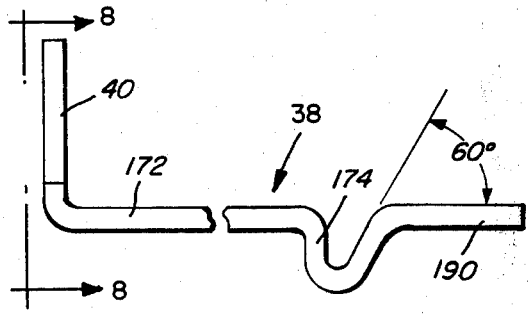
FIG. 7 is a side elevation view of a portion of the latch release mechanism shown in FIGS. 2 and 5.
Figure 8:
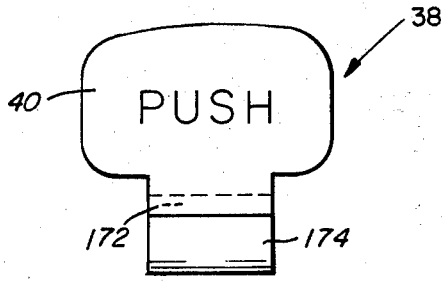
FIG. 8 is a front elevation view of a portion of the latch release mechanism of the stationary connector member shown in FIGS. 1, 3, 5 and 6, taken along the line 8—8 in FIG. 7.

Referring to the drawings, particularly FIGS. 1–4A inclusive, the principal components of the panel/chassis mounted miniature audio connector 10 will now be described. Connector 10 includes the combination of a mounted stationary member, such as, for example, female receptacle member 12 and detachable male member 14. The mounted stationary connector member 12 includes a conductive housing 16, preferrably of a copper alloy with a bright nickel plate, having a hollow post-like section 18 as shown in cross section in FIG. 5. Member 12 also includes a plug insert 20 having a plurality of conductive female receptacles 22 formed therein, electrically insulated from each other by the dielectric insert base 24. As shown in FIGS. 2 and 3 the conductive housing 16 with the plug insert 20 is disposed within hollow collar member 26 also of a copper alloy and nickel plate. Plate 28 extends laterally from member 26 for panel or chassis mounting by means of screw holes 30 (FIG. 12). The latch assembly 36 of the present invention and release mechanism 38 co-operating with the mechanical latch assembly 36 are carried by the conductive housing portion 18 of the stationary female member 12. Push button 40 provides for actuation of the release mechanism 38 to separate the detachable male connector member 14 after interfitting the connector components 12, 14 for electrical continuity. The hollow post-like section 18 is adapted to fit inside the hollow portion of the detachable male connector member 14 when coaxially aligned therewith.

The female pin receptacles 22 (FIG. 2) terminate in crimpable end portions 22*a* which are adapted for connection to signal leads leading to external circuitry such as for example an audio amplifier. Notches 44 are provided to engage and mate with tabs 46 of an insulating spacer 48, preferably of a molded high strength thermoplastic similar to the material employed for the insert base 24 to ensure positive interlocking of the assembled components 24, 48 and ease of the assembly without any soldering. Passageways 50 provide for clearance of the ends 22*a* of the female receptacles 22. Flat portion 52 formed on the top of spacer 48 abuts with flat portion 54 to define a chamber 53 for receiving the latch assembly 36 (FIG. 3).

Figure 5:
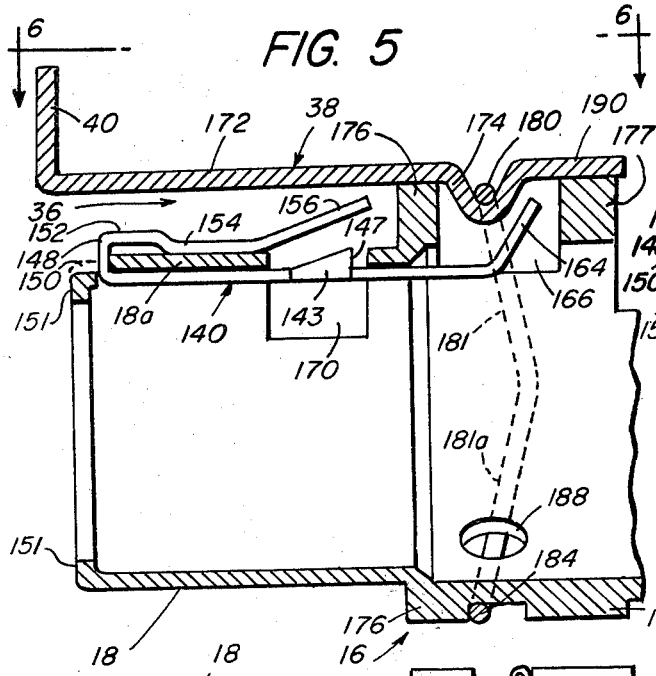
FIG. 5 is detailed cross-sectional view of the post-like conductive housing of the stationary connector member illustrating the mechanical latching system and release mechanism mounted thereon taken along and in the direction of the line and arrows 5—5 in FIG. 6.
Figure 5A:
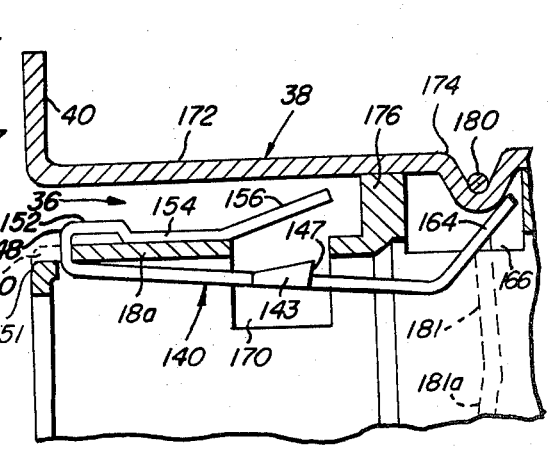
FIG. 5A is a view similar to FIG. 5 showing the release button slid rearwardly to the right to engage and depress the wing portions of the latch assembly to the disengagement position.
Figure 11A:
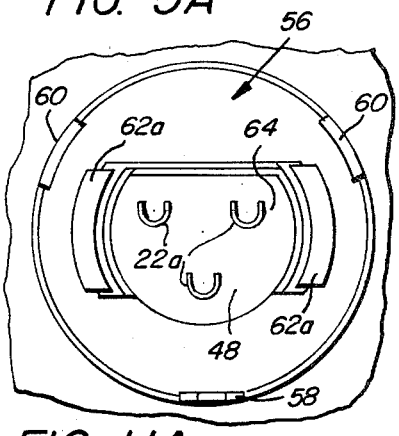
FIG. 11 and FIG. 11A are end elevation views of the locking ring and ground terminal of the stationary female connector member 12, taken along the line 11—11 in FIG. 2.
Figure 11:
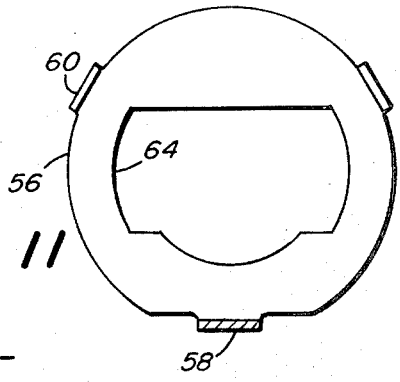

Referring to FIGS. 2, 11 and 11A the lock ring 56, preferably of a hard brass alloy with electro-tined plating has a solder terminal 58 (FIG. 2A) and printed circuit terminal 58*a* (FIG. 2B) and ears 60. Protrusions 62*a* of housing 18 extending through passageway 64 in collar member 26 are peened or staked over adjacent walls of the lock ring (FIG. 11A) to secure components 16, 20, 48 and 26 at one end. End wall 26*a* (FIG. 12) of member 26 abuts lock ring 56 after the lock ring is secured as shown in FIG. 11A. At the other end lip 151 in a passageway within housing 18 retricts movement of the aforesaid components as shown in FIGS. 3, 5 and 5A.

The detachable male connector member 14 comprises a hollow conductive housing 70, as shown in FIG. 4, preferably of a copper alloy with a bright nickel plate. The conductive housing 70 has a threaded section 72, hollow passageway and at the other end a polarization groove 74. For the reasons to be hereinafter described such end also includes a lip 76. The internal components axially disposed within conductive housing 70 include a base-pin insert 78 having a dielectric base 80, preferably of a molded high strength thermoplastic material and a plurality of conductive male contact pins 82, preferably a silver plated copper alloy with a clear chromate coating. The pins 82 are electrically insulated from each other by dielectric base 80 and protrude through the base 80 so as to provide terminal portions 82*a* for connection to signal leads 84 of the cable conductor 86. A ridge 88 engages a lip formed within housing 70 to retain the base within such housing. A hollow insulating spacer 90 having an axial passageway 92 for the signal leads 84 of the cable conductor 86 follows. Such spacer 90 is provided with tabs 94 and 96 to engage notches 98, 100, respectively, formed in a polarized space relationship about the periphery of base 80 to ensure positive interlocking of the assembled components and ease of the assembly without any soldering. The opposing end of insulating spacer 90 includes three circumferentially disposed tabs, here one being invisible, 102 and 104 to frictionally engage the split semi-circular portions 109 of resilient wall 106 of a conductive cable clamp 108. (See FIG. 4A) The tabs 102, 104 engage the inner walls of the split portions 109 of clamp 108 and are held to it by a press fit. In addition the insulating spacer 90 has a raised tab 110 for introduction within the slot 112 of split circular walls 109 of clamp 108 and are held to it by a press fit. Cable clamp 108 as shown in FIG. 4A further comprises rib section 114, rear ears 116 and front ears 118 with the rear ears 116 crimped to the outer cable cover 120, here of rubber or plastic of audio cable 86. The front ears 118 are crimped to the shielding braid 124, here preferably of copper. Plural signal leads 84, whose number is determined by the number of contact pins 82, conventionally, three to five, here only three being shown, are electrically connected, for example by solder to end portions 82*a* of the contact pins 82. Nib 126 in rib section 114 provides for locking of the cable clamp 108 in a slot 192 formed in the threaded end 72 of housing 70 (FIG. 13) to prevent rotation of the clamp. Flared walls 128 engage the inner walls of conductive housing 70 to electrically interconnect cable clamp 108 and, thereby, shielding braid 124 to conductive housing 70 (FIG. 13) for electrical continuity. Cable clamp 108 is preferably fabricated of steel and has an electro-tinned finish.

Referring again to FIGS. 1, 4, 13, connector member 14 further includes end cap 130 secured to the threaded non-mating end 72 of housing 70 by means of internal threads 132. The end cap 130 is preferably of a molded black thermoplastic elastomer. Flex relief boot 134, preferably of a non-rigid rubber material, is appended to the end of end cap 130.

Referring to FIGS. 2, 3, 5, 5A, 6, 13, 13A, 14 the mechanical latch assembly 36 and release mechanism 38 will now be described. Referring first to FIGS. 2, 5, 5A, 13, 13A the latch assembly 36 is a unitary U-shaped, resilient structure having an elongated tongue-like conductive portion 140 and a pair of conductive wing-like members 142, 143, offset from the elongated conductive portion 140, as shown. The offset wing-like members 142, 143 have raised arcuate portions 144, 145 (FIG. 6) and front edges 146, 147 see also (FIG. 6) The elongated portion 140 is adapted to pass through polarization groove 74 of member 14 (FIGS. 4, 5, 9, 13, 13A). The latch 36 includes a bight portion 148 (FIGS. 5, 5A) disposed within notch 150 in housing wall portion 18*a* and is followed by a raised flattened portion 152. Elongated resilient tongue-like portion 154 follows with a slightly upturned depressible end portion 156. Latch assembly 36 is preferably fabricated of beryllium copper and is nickel plated after heat treatment.

Figure 6:
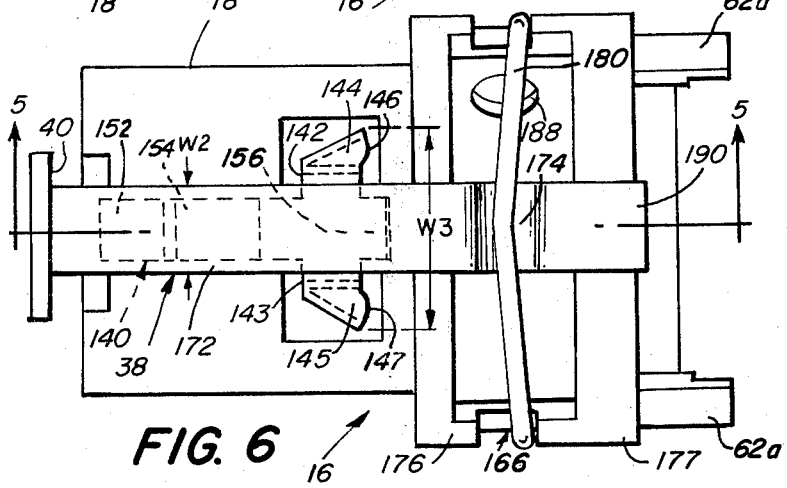
FIG. 6 is a top elevation view of the housing shown in FIG. 5 taken along the line 6—6.
Figure 9:
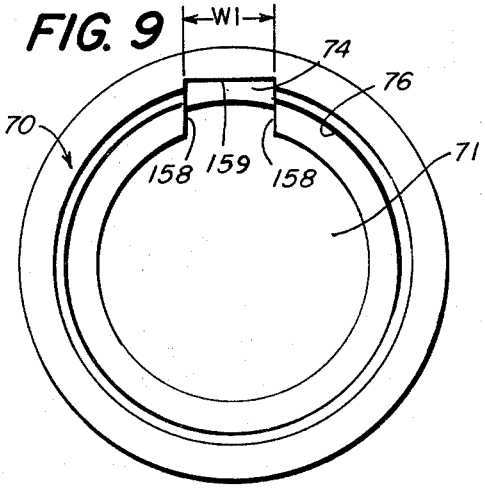
FIG. 9 is an end elevation view of the conductive housing of the detachable male connector member taken along the line 9—9 in FIG. 4.
Figure 10:
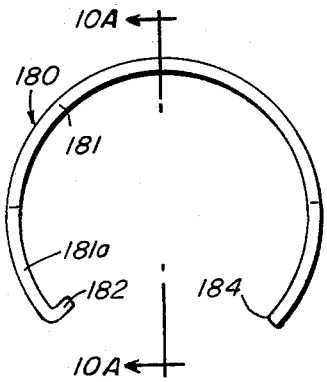
FIG. 10 is an isometric view of the return spring member connecting the latch release mechanism to the conductive housing shown in FIGS. 2 and 5.
Figure 10A:
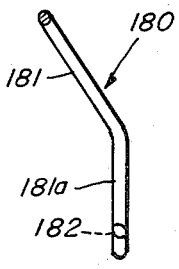
FIG. 10A is a side elevational view of the spring member taken along the line 10A—10A in FIG. 10.

In accordance with the teachings of U.S. Pat. No. 4,316,647, which has been granted to the inventors and assigned to the assignee of this invention, and referring to FIGS. 5, 13, 13A, 14 as well as FIGS. 2, 4, 5, 5A, 6 and 9 the polarization groove 74 is provided within sleeve-like housing 70 to receive and substantially enclose latch assembly 36. The polarization groove 74 having substantially straight upper and side walls 158, 159 (FIG. 9) provides a receptacle for the elongated tongue-like portion 140 of latch 36 so that it mechanically keys the latch to thereby orient the mating of the contact pins 82 within receptacles 22 (FIGS. 13, 13A), prior to their engagement to prevent damage by bending through misalignment. Polarization groove 74 extends substantially throughout half of the length of housing 70. In FIG. 9 the width $W_1$ of the polarization groove 74 is slightly larger than width $W_2$ of tongue-like portion 154 of latch 36 to receive such portion 154 (FIG. 6). The width $W_1$ of groove 74, however, is smaller than the width $W_3$ across the pair of wing-like members 142, 143. Such members 142, 143 in particular, edges 146, 147 of such members engage the lip portion 76 (FIGS. 9, 13) of housing 70 when the connector members 12, 14 are interfitted. In addition, the raised portion 144, 145 of the wing-like members engage the walls 76 adjacent the groove 74, also shown in FIGS. 9, 14.

Figure 13:
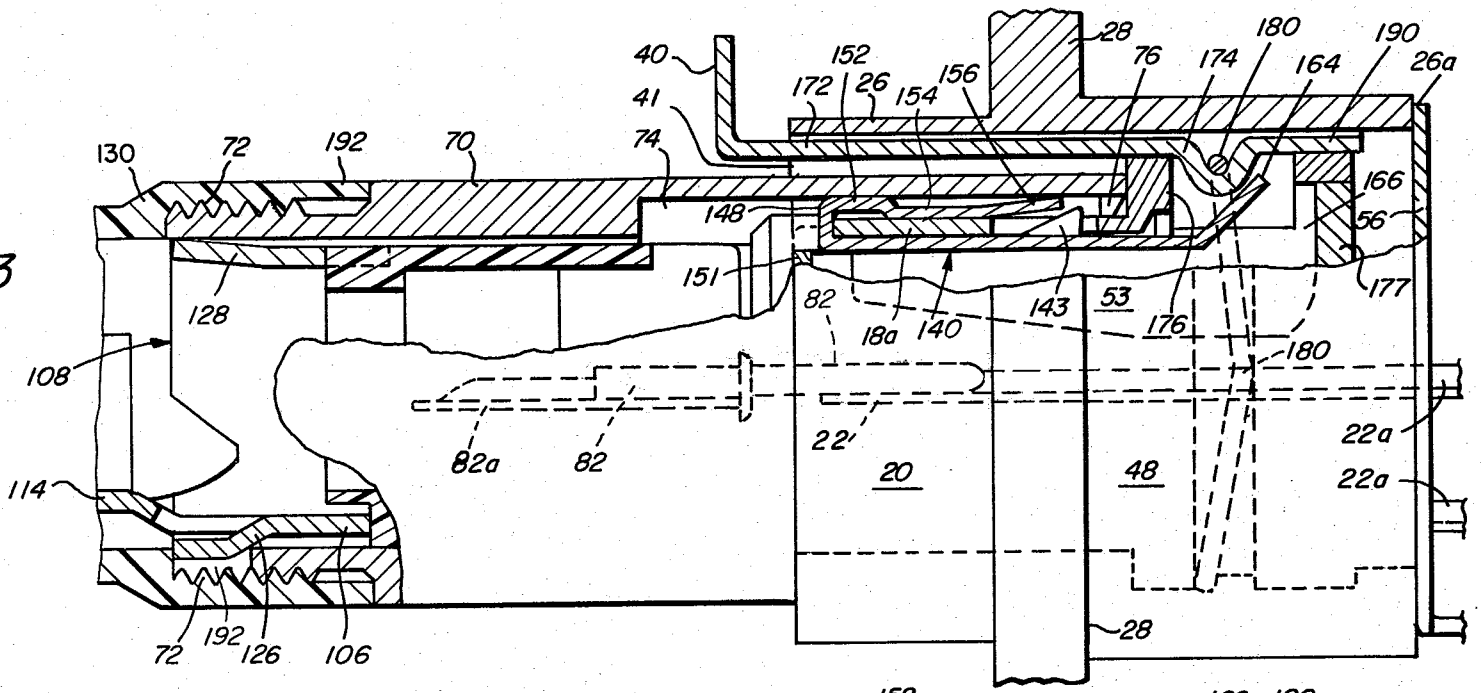
FIG. 13 is a partial cross-sectional and side elevation view of the male and female connector members in the engaged or inter-mated position, together with internal structure also shown in cross section.
Figure 13A:
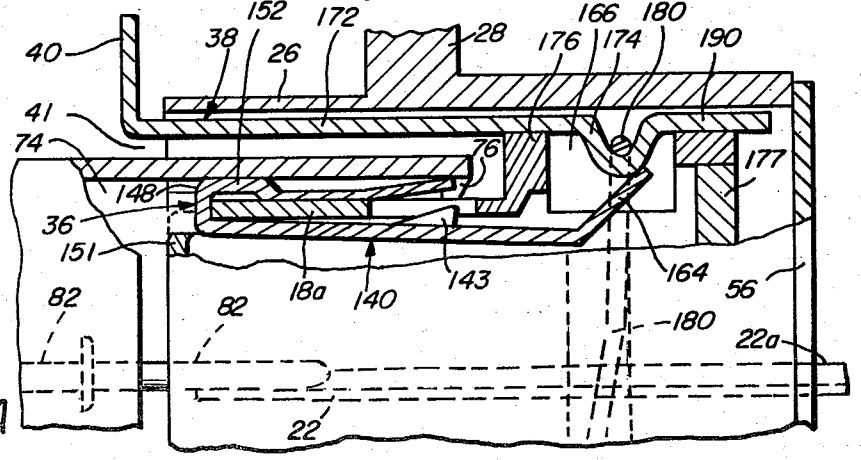
Figure 14:
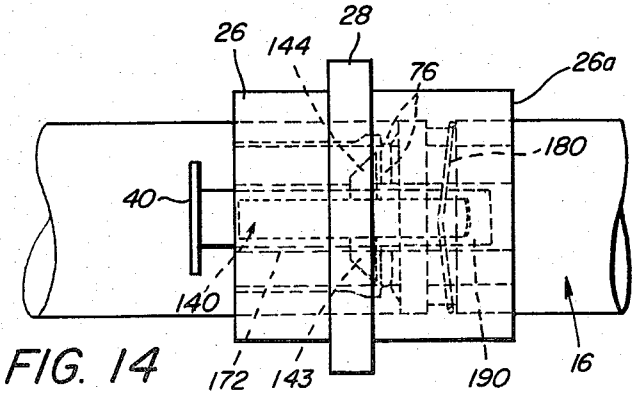
FIG. 14 is a plan view partially broken away to reveal underlying structure of the mated male and female connector members.

The lip 76 adjacent the entrance to the hollow passageway 71 in housing 70 provides for positive latching of the interfitted housings 16 and 70 (FIGS. 13–14 inclusive). The lip 76 is contacted by the front edges 146, 147 of the offset wing-like members after insertion of the latch 36 within the polarization groove 74. The combination of mechanical forces evolving with the compression of latch end 156 by contact with the upper straight wall 159 (FIG. 9) forming polarization groove 74 and the compression of the wing-like arcuate portions 144, 145 by the housing walls adjacent to the groove 74 provide for the vibration-resistant, anti-rattle characteristics of the mated members of the overall miniature audio connector. The disposition of the wing-like members front edges against lip 76 when the mated stationary and detachable connector members and interfitted (FIGS. 13, 13A, 14) in addition to providing for positive latching, contributes to the minimum axial play to thereby assure positive interconnection of the housings and contact pins within the receptacle for high integrity circuit continuity in an audio system. When the connector members are interfitted the end portion 156 of latch 36 is under compression and contacts the upper straight walls 159 of the polarization groove. Likewise, elongated portion 140 is forced against the conductive housing portion 18*a* of conductive housing 16. In this way, latch 36 ensures circuit continuity between conductive housings 16 and 70.

Referring to FIGS. 5, 5A, 13, 13A the latch assembly 36 is shown provided with an upturned portion 164 of the end of elongated portion 140 and extends within groove 166 in conductive section 18. The wing-like portions 143, 144 of the latch assembly extend within notch 170 and depression of the upturned portion 164 results in the disengagement of the front portions of the wing-like members 143, 144 from the lip portion 76 of the polarizaton groove 74 to provide clearance for the movement of the wing-like members and withdrawal of the detachable connector member 14 from the stationary connector member 12 and the breaking of the audio circuit, FIG. 5A, 13A.

Referring to FIGS. 2, 3, 5, 5A, 6, 7, 8, 10, 10A the release mechanism 38 for actuating the latch assembly 36 will be described. An elongated slidably disposed release lever 172 of cold rolled steel with a bright nickelplate has an intermediate substantially V-shaped portion 174 bridging ring-like portions 176, 177 of conductive housing 18 section and an upturned push button 40. A return spring 180 of tinned 0.014 music wire (FIGS. 10, 10A) engages V-section 174 with an end 184 disposed within groove 166 (FIG. 6) defined between rings 176, 177 and the opening end 182 defining a hook disposed within aperture 188 in body section 18, as shown in FIGS. 5 and 6. The V-section 174 is formed with an angle of approximately 60 degrees (FIG. 7) with end portion 190 of the elongated lever 172 of the latch release mechanism 38 adapted to be supported on ring wall section 177. In FIGS. 12, 13, 13A groove 41 in the wall of the collar member 26 is defined by top and sidewalls 43, 45, respectively, to provide for disposition of release lever 172. The configuration of end wall 26*a* (FIG. 12) is also shown conforming to end 62 (FIG. 11A) of conductive housing 18. Lock ring 56 is secured to wall 26*a*, as by staking wings 62*a* or soldering (FIG. 11A) The depression of button 40 (FIGS. 5A, 13A) results in the rearward movement of the V-section 174 against the upturned portion 164 of the latch portion 140. The flexing of the return spring 180 section 181 provides a downward as well as rearward motion to result in depressing the wing-like members 142, 143 to disengage the front edges 146, 147 from the lip portion 76 of the polarization groove 74 and thereby permit withdrawal of the connector member 70 from the stationary connector member 12 to separate the components and break the circuit. The bend in return spring 180 (FIG. 10A) provides for return of latch lever 172 to a position with button 40 anteriorly disposed as shown in FIGS. 1, 3, 6, 13, 13A.

In FIG. 2 of the referenced copending patent application Ser. No. 99,046, another illustration of an audio connector is shown wherein a stationary male member 120 is mated with a detachable female member 14, bearing latch assembly 62 for positive latching, reducing mechanical vibration and ensuring circuit continuity. Here the polarization groove 126 is in the stationary member 120 and the latch assembly is provided in the detachable female connector 14. In the present application the disposition of the polarization groove 74 and latch assembly 36 is reversed with the polarization groove now disposed in the detachable member 14 while the latch assembly 36 is disposed in the stationary female receptacle connector member 12. It is to be understood, therefore, that although the polarization groove, release mechanism and latch assembly have been shown and described herein in a specific manner in the respective male and female connector housings, such components may be reversed, if desired, and disposed in opposite housings from those disclosed herein. Further, it will be apparent to those skilled in the art that various modifications and changes in the preferred embodiments, shown and described herein may be made, and that such changes may be made by those skilled in the art without departing from the spirit and scope of the invention as expressed in the accompanying claims. Therefore, all matter shown and described is to be interpreted in an illustrative rather than in a limiting sense.

What is claimed is:

1. An audio connector comprising:

(a) a first connector member comprising: a sleeve-like housing having a lip and a polarization groove passing through a portion of the lip; and at least one electrical conductor;

(b) a second connector member comprising:

(i) a post-like housing having a longitudinal portion;

(ii) at least one electrical conductor adapted to contact the electrical conductor of the first member;

(iii) a mounting member comprising a collar and plate member, said post-like housing of said second member being disposed within said collar member;

(iv) a mechanical latching system carried by said longitudinal portion of the post-like housing including a unitary resilient tongue-like latch member with intermediate offset wing-like members, said tongue-like member being slidably disposable within said polarization groove and such wing-like members being engageable with the lip of the first member to interlock the first and second members when said first member is mated with said second member; and (v) a release mechanism cooperating with said tongue-like latch member including a lever slidably disposed between the collar member and longitudinal portion of the second member.

2. An electrical connector comprising:

(a) a first detachable connector member comprising a sleeve-like conductive housing having a lip and an elongated polarization groove passing through a portion of the lip, such member including at least one electrical contact pin;

(b) a second connector member comprising:

(i) a post-like conductive housing having a longitudinal portion;

(ii) at least one conductive contact pin receptacle adapted to interfit with the contact pin of first member;

(iii) a mounting plate comprising a hollow collar member said post-like housing of said second member being disposed within said hollow collar member;

(iv) a mechanical latching-system carried by said longitudinal portion of said postlike housing including: a unitary elongated resilient tongue-like latch member with intermediate offset wing-like members, said tongue-like member being slidably disposed within said polarization groove when said first member is mated with said second member; such wing-like members engaging the lip of the sleeve-like housing to interlock the first and second members; and (v) a release mechanism engaging said latch member including:

(vi) an elongated longitudinal lever slidably disposed between the hollow collar member of the mounting plate and the longitudinal housing portion of the second member and an outwardly disposed upturned push button; said release lever being moved longitudinally and rearwardly upon actuation of the push button to move a portion of the member and disengage the wing-like members from the said lip of the sleeve-like housing to permit separation of the interlocked first and second members.

3. An audio connector comprising:

(a) a first detachable connector member comprising: a hollow sleeve-like housing having a lip and a polarization groove passing through a portion of the lip; such member including at least one conductive contact;

(b) a second connector member comprising:

(i) a post-like housing having a longitudinal portion;

(ii) at least one conductive receptacle adapted to interfit in coaxial alignment with the contact of the first member when said first member is interfitted with said second connector member;

(iii) a hollow collar member having a plate member adapted for primarily stationary mounting; said second connector member housing being disposed within said collar member;

(iv) a mechanical latching system carried by said second connector including: a unitary resilient tongue-like latch member with intermediate offset wing-like members; said tongue-like member being adapted to be slidably disposed within said polarization groove when said first detachable connector member is mated with said second stationary connector member; such wing-like members engaging the lip of the hollow sleeve-like housing to interlock the first and second member; and (v) a spring-actuated release mechanism cooperating with said elongated tongue-like latch member including an elongated longitudinal lever slidably disposed adjacent to said latch member and an outwardly disposed appended upturned push button; said elongated release lever being moved rearwardly upon actuation of said push button to contact the latch member and disengage the wing-like members from the lip of said hollow sleeve-like housing to permit disengagement of the interlocked first and second members.

4. The audio connector according to claim 3 wherein the slidably disposed elongated release lever includes an intermediate substantially V-shaped portion adapted to contact and move said latch member.

5. The audio connector according to claim 4 wherein the unitary tongue-like latch member is substantially U-shaped with a substantially flattened section adjacent a bight portion followed by a first upturned portion and a second upturned portion adjacent respective terminal ends of the latch member;

the flattened and first upturned portions being adapted to slidably engage and be compressed by the upper walls of the polarizaton groove upon mating and interlocking of the first and second connector members when interfitted;

said V-shaped release lever portion engaging the second upturned portion of the latch member when said release lever is slidably actuated.

6. The audio connector according to claim 5 wherein a resilient return spring member encircles and is anchored to the post-like housing of the second connector member, the return spring member being disposed within the V-shaped portion of the latch release elongated lever.

7. The audio connector according to claim 3 wherein the second connector member includes a terminal lock ring member adapted to abut and be secured to the hollow collar member end wall.

8. An electrical socket comprising:

(a) a post-like housing having a longitudinal portion;

(b) at least one electrical conductor adapted to contact an electrical conductor of a plug, such plug having a sleeve-like housing with a lip and a polarization groove passing through a porton of the lip, such plug also having an electrical conductor;

(c) a mounting member comprising a hollow collar portion and a plate member, said post-like housing being disposed within said collar portion;

(d) a mechanical latching system carried by said longitudinal portion of the post-like housing including a unitary resilient tongue-like latch member with at least one offset wing-like member, said tongue-like member being slidably disposed within said polarization groove of the plug and such wing-like member being engageable with the lip of the sleeve-like housing of such plug to interlock the plug and the socket; and (e) a release mechanism cooperating with said tongue-like latch member including a lever slidably disposed between the collar portion and longitudinal portion of the post-like housing.

* * * * *

UNITED STATES PATENT AND TRADEMARK OFFICE

CERTIFICATE OF CORRECTION

PATENT NO. : 4,361,375

DATED : November 30, 1982

INVENTOR(S) : James R. Bailey and John R. Herron

It is certified that error appears in the above-identified patent and that said Letters Patent is hereby corrected as shown below:

Column 5, line 64, change "and" (second occurrence) to --are--.

Column 6, line 32, change "opening" to --opposing--.

Column 10, line 13, change "disposed" to --disposable--.

Signed and Sealed this

Fourth Day of October 1983

[SEAL]

*Attest:*

GERALD J. MOSSINGHOFF

*Attesting Officer*

*Commissioner of Patents and Trademarks*